United States Patent [19]

Gauthier

[11] Patent Number: 4,943,327

[45] Date of Patent: Jul. 24, 1990

[54] PROCEDURE TO FORM A NON-WOVEN CLOTH MADE OF SYNTHETIC FILAMENTS

[75] Inventor: Maurice Gauthier, Hiersac, France

[73] Assignee: Asten Group, Inc., Charleston, S.C.

[21] Appl. No.: 160,917

[22] Filed: Feb. 26, 1988

[30] Foreign Application Priority Data

Feb. 27, 1987 [FR] France ..... 87 02674

[51] Int. Cl.[5] ..... B32B 31/30

[52] U.S. Cl. ..... 156/62.6; 68/44; 68/204; 134/68; 156/281

[58] Field of Search ..... 156/62.2, 62.4, 62.6, 156/62.8, 229, 244.11, 309.6, 244.24, 281, 282, 308.2; 15/302, 306 R, 320; 68/20, 44, 200, 204, 205 R; 134/68

[56] References Cited

U.S. PATENT DOCUMENTS

| | | | |
|---|---|---|---|
| 3,966,544 | 6/1976 | Johnson | 162/199 |
| 4,359,501 | 11/1982 | DiTullio | 428/245 |
| 4,373,362 | 2/1983 | Fleissner | 68/62 |
| 4,488,928 | 12/1984 | Khan et al. | 156/495 |
| 4,548,856 | 10/1985 | Khan et al. | 428/171 |
| 4,643,775 | 2/1987 | Reba | 15/302 |

OTHER PUBLICATIONS

"L'Industrie Textile", No. 1154, Apr., 1985, pp. 355–360, With Translation of Section K, p. 359 (2 pgs.).

*Primary Examiner*—Merrell C. Cashion, Jr.
*Attorney, Agent, or Firm*—Volpe and Koenig

[57] ABSTRACT

Procedure to form a non-woven cloth (6) made of synthetic filaments (5) in which synthetic filaments (5) are extruded, stretched, cooled, and projected onto a moving plastic fabric (1), which is characterized by cleaning the plastic fabric (1) by passing a hot liquid fluid at high speed over the point $t_2$ of the filaments (5) and the melting point $t_1$ of the fabric (1), the melting point of the latter being at least 80° C. above that of the filaments (5).

As an example, the fabric can be of polyetheretherketone yarns or of polyphenylene sulfide yarns.

Easy installation of the fabric and possibility to clean it and therefore increase its life.

5 Claims, 1 Drawing Sheet

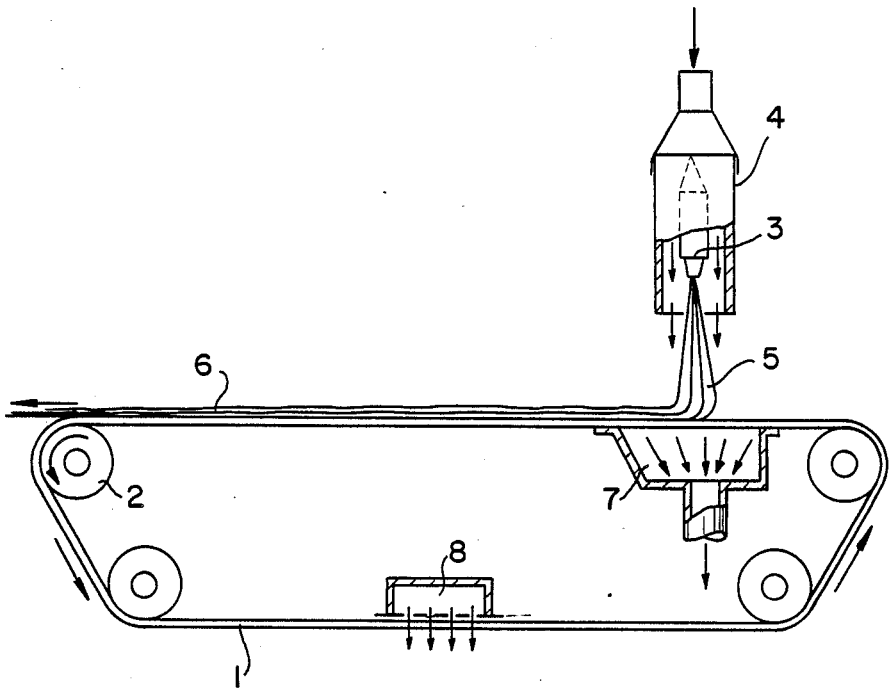
4
3
5
6
2
7
8
1

PROCEDURE TO FORM A NON-WOVEN CLOTH MADE OF SYNTHETIC FILAMENTS

BACKGROUND OF THE INVENTION

The present invention relates to a procedure to form a non-woven cloth made of synthetic filaments in which synthetic filaments are extruded, stretched, cooled, and projected onto a plastic fabric that is in movement. Known procedures are the SPUNBONDED and MELTBLOWN procedures.

To apply these already known procedures, extrusion dies are used which are placed above a forming fabric. Thermoplastic polymers, such as polyester, polyamide, polyolefins, etc. are hot-extruded. By means of a violent air current, the filaments are stretched, cooled and projected onto the endless forming fabric, which moves at a constant speed, to form a non-woven cloth. A suction system under the forming fabric makes it possible to eliminate the air pockets and to adhere the cloth against the forming fabric.

When the system is turned on or off, such as may result from malfunctions, it can happen that drops of melting polymer from the extruder fall on the fabric and become embedded in the forming fabric. This damages the quality of the cloth and sometimes causes the removal of the forming fabric because the cloth filaments may cling to these impurities, and the cloth will be poorly formed if the clogged areas are too big.

The use of plastic forming fabrics is already known. Because of their flexibility, they make installation easy and are easily guided, but it is not possible to clean them, and consequently, their life span is relatively short. If we use heat to soften of felt impurities fabrics will shrink or melt locally which is not acceptable. For instance this is the case when running polyester monofilament fabrics to make polypropylene non-woven.

Thus, the use of metallic fabrics, despite their heaviness and stiffness, which makes installation difficult and time consuming and, when in operation, their tendency to accidentally crease, has received wide acceptance.

In fact, the only real advantage of metallic fabrics is that they can be cleaned relatively easy by using a hot, high temperature source, such as open flame. But heat tends to expand fabric locally creating creases which are not acceptable.

According to the present invention, a forming fabric made of special plastic filaments is used, the melting point temperature, $t_1$, of these special filaments is at least 80° C. higher than the melting point temperature, $t_2$, of the filaments that constitute the non-woven cloth; this will make it possible to clean the forming fabric by passing a hot cleansing fluid, i.e. steam or hot air, over it at high speed, the temperature of the cleansing fluid is controlled and lies between $t_1$ and $t_2$ and should preferably be $$\frac{t_1 + t_2}{2}.$$

The invention also relates to forming fabrics that allow the application of the procedure.

Suitable forming fabrics can be made of a polyphenylene sulfide ($t_1$=280° C.) which is a relatively cheap material. In such a case, polymer filaments extruded from a material with a melting point of $t_2$ no greater than 200° C. will be used to form the cloth. One such family of materials suitable for use in this case is polyolefins.

In a higher temperature application of the invention, one can use fabrics made of polyetheretherketone which has a melting point $t_1$ around 330°. In this case, polymer filaments materials such as polyester and polyamide with a melting point around 230° C. can be used to form the cloth.

SUMMARY OF THE INVENTION

A procedure to form a non-woven cloth (6) made of synthetic filaments (5), a cloth in which synthetic filaments (5) are extruded, stretched, cooled and projected onto a plastic fabric (1) which is in movement, characterized by cleaning the plastic fabric (1) by passing a hot fluid at high speed over the fabric which has a temperature approximately half the difference between the melting point $t_2$ of the filaments (5) and the melting point $t_1$ of the fabric (1), with the melting point of the fabric being at least 80° C. above that of the filaments (5).

BRIEF DESCRIPTION OF THE DRAWINGS

The present invention will be better understood in light of the drawing, which is a schematic representation of the means to implement the procedure according to the invention.

DESCRIPTION OF THE PREFERRED EMBODIMENTS

A closed or endless plastic fabric (1) is prepared and mounted around the rolls (2). Above the upper horizontal portion of the fabric (1), one places a group of extrusion dies (3), which is surrounded with an air jet generator (4). The dies (3) that are placed vertically and over the entire width of the fabric (2), are intended for the extrusion of synthetic filaments (5) which, by means of the air jet that is generated from the surrounding generator (4), are projected onto the continuously moving fabric (1) in order to form the cloth (6). The cloth (6) adheres to the fabric (1) through air suction produced by a device (7) that is located underneath the fabric (1).

When the cloth has left the forming fabric (1), a hot fluid (steam or air) is applied at high speed with a device (8) that is placed near the fabric (1). The temperature of this fluid is chosen near $$t = \frac{t_1 + t_2}{2}$$

being the melting point of the of the fabric and $t_2$ that of the filaments. The fabric material (1) was chosen in such a way that $t_1$ will be at least 80° C. above temperature $t_2$.

In this manner, the fabric (1) can be cleaned by making the drops of substance that are glued into the fabric melt away without damaging the fabric. The fabrics (1) are made of single or multi-layer monofilaments in the warp and filling. They are thermally stabilized depending on the conditions for which they will be used.

The characteristics of the forming fabrics (1), such as air permeability, weave, surface condition, are chosen according to the characteristics of the non-woven cloth (6) that is to be formed. Their weight can be anywhere between 500 to 1,500 gr/m2 and their permeability can range from 4,000 to 25,000 m3/m2/h under a differential pressure of 100 Pascals.

These fabrics can be endless or seamed. The latter can be made of loops at each end of the fabric. In that case, (if seamed) it is worthwhile to prepare two series of loops with different lengths for each end of the fabric as described in French Patent No. 72 27 942.

What I claim is:

1. An improved procedure for forming a non-woven cloth (6) of synthetic filaments (5), having a melting point $t_2$ by extruding, stretching, cooling and projecting said synthetic filaments (5) onto a moving plastic forming fabric (1), the improvement characterized by providing a plastic forming fabric (1) having a melting point $t_1$ which is at least 80° above the melting point $t_2$ and cleaning the plastic forming fabric (1) by passing hot fluid, having a temperature t which is approximately $$\frac{t_1 + t_2}{2},$$

over the plastic forming fabric (1).

2. The procedure of claim 1 where t is defined by the equation t=

$$t = \frac{t_1 + t_2}{2}.$$

3. The procedure of claim 1, wherein the temperature t of the hot fluid is always 40° greater than the melting point $t_2$ of the synthetic monofilaments (5).

4. The procedure of claim 1, wherein the temperature t of the hot fluid is always 40° less than the melting point $t_1$ of the plastic forming fabric (1).

5. The procedure of claim 1, wherein $$\frac{t_1 + t_2}{2}$$

is always 40° less than the melting point of the forming fabric (1).

* * * * *

UNITED STATES PATENT AND TRADEMARK OFFICE

CERTIFICATE OF CORRECTION

PATENT NO. : 4,943,327

DATED : July 24, 1990

INVENTOR(S) : Maurice Gauthier

It is certified that error appears in the above-identified patent and that said Letters Patent is hereby corrected as shown below:

On the Title Page,
In the Abstract, line 6, after the words "over the", insert --fabric, the melting point of which lies between the melting--.
Column 1, line 34, delete the words "of felt" and insert the words --or melt--.
Column 1, line 34, after the word "impurities", insert a comma--,--.
Column 1, line 45, after the word "flame", delete ". But" and insert --, but--.
Column 2, line 53, before the word "bing" insert ----$t_1$--.
Column 2, line 53, delete the words "of the" last occurrence.
Column 2,line 60, after the word "filling", insert --or spirals assembled together--.

Signed and Sealed this

Twenty-ninth Day of December, 1992

*Attest:*

DOUGLAS B. COMER

*Attesting Officer*

*Acting Commissioner of Patents and Trademarks*